US011435045B2

(12) United States Patent
Drüppel et al.

(10) Patent No.: US 11,435,045 B2
(45) Date of Patent: Sep. 6, 2022

(54) LIGHTING DEVICE FOR A MOTOR VEHICLE

(71) Applicant: Hella GmbH & Co. KGaA, Lippstadt (DE)

(72) Inventors: Mathias Drüppel, Lippstadt (DE); Bernd Fischer, Altenbeken (DE); Marc Kaup, Paderborn (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/336,955

(22) Filed: Jun. 2, 2021

(65) Prior Publication Data

US 2021/0285610 A1 Sep. 16, 2021

Related U.S. Application Data

(63) Continuation of application No. PCT/EP2019/059757, filed on Apr. 19, 2019.

(30) Foreign Application Priority Data

Dec. 7, 2018 (EP) ..... 18211096

(51) Int. Cl.
*F21S 41/12* (2018.01)
*F21S 41/32* (2018.01)
(Continued)

(52) U.S. Cl.
CPC ..... *F21S 41/12* (2018.01); *F21S 41/322* (2018.01); *F21W 2102/40* (2018.01); *F21Y 2115/30* (2016.08)

(58) Field of Classification Search
CPC ..... F21S 41/25–275; F21S 41/63–645; F21S 41/67
See application file for complete search history.

(56) References Cited

U.S. PATENT DOCUMENTS

2004/0201904 A1 10/2004 Togino
2005/0248861 A1 11/2005 Minakata
(Continued)

FOREIGN PATENT DOCUMENTS

DE 19530008 A1 2/1997
DE 10344173 A1 4/2005
(Continued)

*Primary Examiner* — Mariceli Santiago
(74) *Attorney, Agent, or Firm* — Husch Blackwell LLP

(57) ABSTRACT

A Lighting device for a motor vehicle is provided comprising at least one light source from which light is emitted during operation of the lighting device. An optical component into which the light emanating from the at least one light source enters is also provided, along with a light influencing means having an active surface for selectively influencing individual pixels or groups of pixels of the light. The light influencing means reflects or deflects light incident thereon in such a way that it emerges at least partially from the lighting device. Illumination optics are formed on or in the optical component. The light is reflected or deflected by the illumination optics during operation of the lighting device onto the active surface of the light influencing means. The light influencing means is arranged outside the optical component in such a way that light emanating from the illumination optics emerges from the optical component, impinges on the active surface of the light influencing means, is reflected or deflected by the latter, and then re-enters into the optical component.

13 Claims, 1 Drawing Sheet

(51) Int. Cl.
*F21Y 115/30* (2016.01)
*F21W 102/40* (2018.01)

(56) References Cited

U.S. PATENT DOCUMENTS

| | | | | |
|---|---|---|---|---|
| 2010/0208478 | A1* | 8/2010 | Fang | B60Q 1/085 362/466 |
| 2015/0377430 | A1 | 12/2015 | Bhakta | |
| 2018/0186278 | A1 | 7/2018 | Song et al. | |
| 2019/0368715 | A1* | 12/2019 | Tsuda | F21S 41/675 |

FOREIGN PATENT DOCUMENTS

| | | | |
|---|---|---|---|
| DE | 102010048659 | A1 | 4/2012 |
| DE | 102013215374 | A1 | 2/2015 |
| DE | 102014225246 | A1 | 7/2015 |
| DE | 102014105963 | A1 | 10/2015 |
| DE | 102015107086 | A1 | 11/2016 |
| DE | 102015012020 | A1 | 3/2017 |
| DE | 102015012021 | A1 | 3/2017 |
| DE | 102015016375 | A1 | 6/2017 |
| DE | 102016006391 | A1 | 11/2017 |
| DE | 102016211653 | A1 | 12/2017 |
| DE | 102016114247 | A1 | 2/2018 |
| DE | 102016120222 | A1 | 4/2018 |
| DE | 102017102478 | A1 | 10/2018 |
| DE | 102017005019 | A1 | 11/2018 |
| DE | 102017109679 | A1 | 11/2018 |
| DE | 102017209148 | A1 | 12/2018 |
| DE | 10201810115045 | A1 | 12/2018 |
| EP | 2772682 | A2 | 9/2014 |
| FR | 3055980 | A1 | 3/2018 |
| FR | 3057336 | A1 | 4/2018 |
| JP | 11337863 | A | 12/1999 |
| WO | 98/52386 | A1 | 11/1998 |
| WO | 03/056876 | A2 | 7/2003 |
| WO | 2013164276 | A1 | 11/2013 |
| WO | 2018077633 | A1 | 5/2018 |
| WO | 2018234531 | A1 | 12/2018 |

* cited by examiner

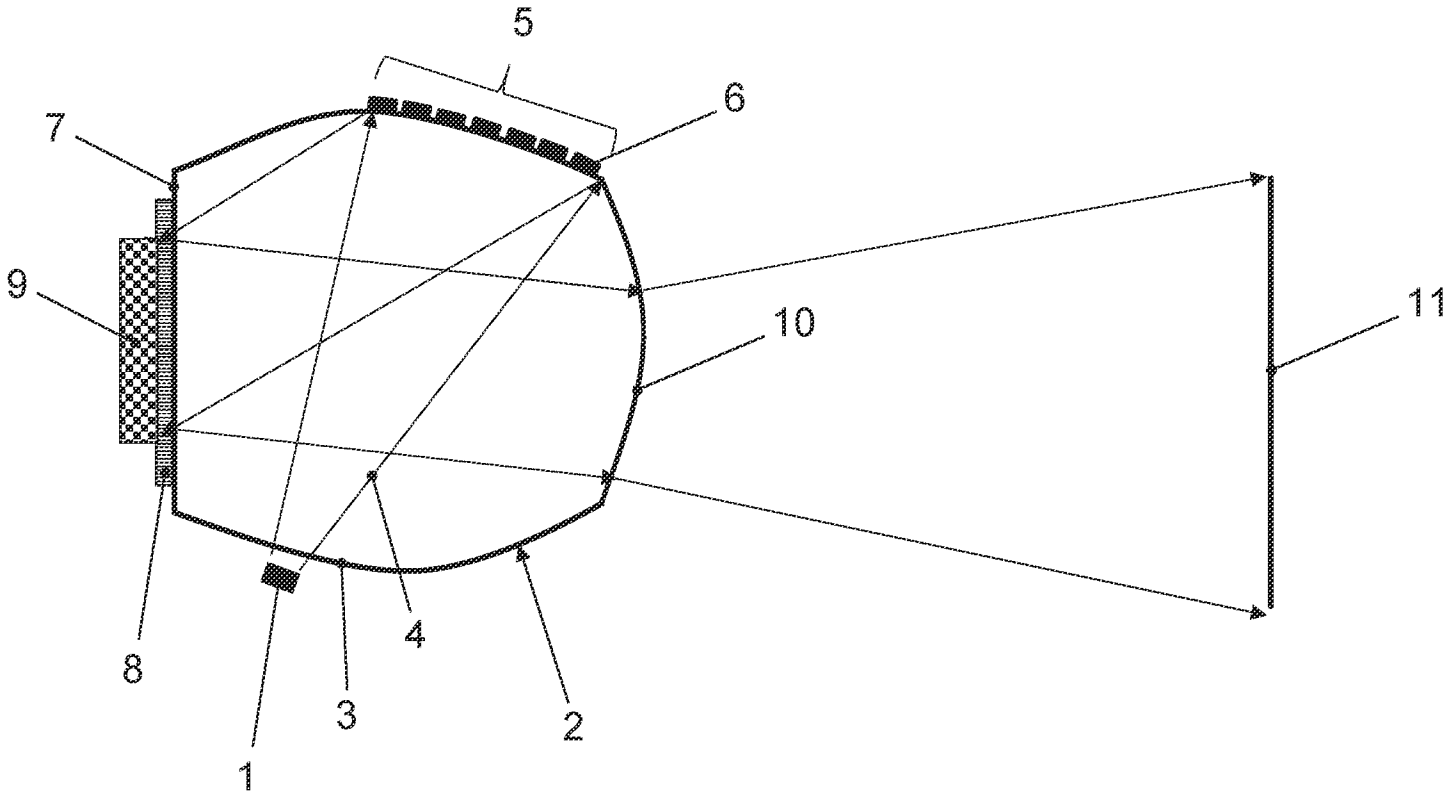
11
10
6
5
2
4
3
1
8
7
9

LIGHTING DEVICE FOR A MOTOR VEHICLE

CROSS REFERENCE

This application is a continuation of and claims priority to PCT Application No. PCT/EP2019/059757, filed Apr. 16, 2019, which claims priority to European Application No. 18211096.5, filed Dec. 7, 2018, the entirety of both of which are hereby incorporated by reference.

FIELD OF THE INVENTION

The present invention concerns a lighting device for a motor vehicle, in particular a headlamp for a motor vehicle.

BACKGROUND

High-resolution headlamp projection modules according to the state of the art use a large number of optically relevant components, which have to be adjusted to each other. These are, for example, light influencing means serving as imaging elements, such as a digital micro-mirror device (DMD) or an LCoS (Liquid Crystal on Silicon) or LC display, as well as illumination optics for illuminating the imaging element. The imaging element can specifically reflect or shadow or deflect individual pixels or groups of pixels of light in such a way that it emerges at least partially from the lighting device. Furthermore, decoupling optics are usually used to image an active surface of the light influencing means into the traffic area.

A lighting device of the type mentioned above is known from DE 10 2018 115 045 A1. The lighting device described therein may be designed as a high-resolution headlamp. The lighting device comprises two monolithic components made of a transparent material, one of which serves as illumination optics and the other as decoupling optics. The lighting device also includes a digital micro-mirror device which serves as an imaging element and is located between the first monolithic component and the second monolithic component.

SUMMARY OF THE INVENTION

The purpose of the present invention is to create a lighting device of the aforementioned kind, which has a smaller number of optical components.

The light influencing means is arranged outside the optical component in such a way that light emanating from the illumination optics emerges from the optical component, impinges on the active surface of the light influencing means, is reflected or deflected by the latter and then re-enters into the optical component. In contrast to the state of the art, this reduces the adjustment effort for the lighting device. In particular, a high-resolution headlamp projection module with a smaller number of components can be realized.

The light influencing means may be in direct or indirect contact with an outside of the optical component, in particular in direct or indirect contact with a refractive surface of the optical component, through which light can exit from the optical component and enter the optical component. It is possible that a connecting layer, for example made of liquid silicone rubber (LSR), is arranged between the outside of the optical component and the light influencing means. Light losses can be reduced by the connecting layer.

It may be provided that the light influencing means are designed as a digital micro-mirror device or as an LCoS or as an LC display, or that the light influencing means comprise a digital micro-mirror device or an LCoS or an LC display The light influencing means may be designed to reflect portions of the light emitted from the optical component back to the optical component. An example of this is a reflective LC display.

It is possible for the illumination optics to comprise a reflector having a single uninterrupted mirror surface or a plurality of mirror elements. For example, the reflector may have a concave curved base surface. Preferably, the reflector can be formed by a reflecting surface of the optical component, which can in particular have at least one reflecting layer applied to the outside of the component. The optical component can be compactly dimensioned by folding the beam path inside the optical component as a result of the reflection.

The lighting device preferably comprises decoupling optics through which the light emitted by the influencing means emerges from the lighting device during operation of the lighting device. It may be provided that the decoupling optics are integrated into the optical component, in particular are realized by a refractive exit surface of the optical component. The exit surface can be aspherically curved and/or designed as a free-form surface. By the formation of the decoupling optics on or in the optical component, the number of parts of the lighting device to be adjusted to each other is further reduced. This is the first time that a combination of illumination optics, an imaging element and decoupling optics has been combined on or in a single prefabricated component, eliminating the need to adjust several optically relevant components to each other in headlamp finishing.

It is possible that the optical component is a monolithic component consisting of glass or polycarbonate (PC), for example. A prefabricated monolithic or one-piece component is robust and compact.

It may be provided that at least one light source is a laser light source, especially a semiconductor laser, or a light-emitting diode. It is also possible to use several semiconductor lasers or several light-emitting diodes or to combine at least one semiconductor with at least one light-emitting diode.

BRIEF DESCRIPTION OF THE DRAWINGS

Reference is now made more particularly to the drawings, which illustrate the best presently known mode of carrying out the invention and wherein similar reference characters indicate the same parts throughout the views.

FIG. 1 is a schematic view of an example of a lighting device according to the invention.

DETAILED DESCRIPTION OF THE DRAWINGS

The illustrated example of a lighting device comprises a light source 1, which is designed in particular as a semiconductor laser or light-emitting diode. It is possible to provide more than one semiconductor laser and/or more than one light-emitting diode.

The lighting device also includes a monolithic component 2 made of glass or polycarbonate, for example. The optical component 2 has a refractive entry surface 3 through which the light 4 emitted by light source 1 can enter the optical component 2.

On the side of optical component 2 opposite the entry surface 3, a reflector 5 is arranged, which is formed in particular as a facetted reflecting region with a plurality of mirror elements 6. However, it is possible to provide the reflector 5 with a single, uninterrupted mirror surface.

The reflector 5 is formed by a reflecting surface of optical component 2, which may in particular have at least one reflecting layer applied to the outside of optical component 2. The reflecting surface forming the reflector 5 can be curved, in particular concave curved, or plane.

The refractive entry surface 3 and the reflector 5 form illumination optics from which the light 4 emitted by the light source 1 is directed onto the light influencing means 9 described below in detail.

The reflector 5 is inclined in such a way that the light 4 is reflected by the reflector 5 onto a refractive surface 7 of optical component 2 different from the entry surface 3. On the outside of this refractive surface 7, the light influencing means 9 are coupled. The coupling of the light influencing means 9 is realized via a connecting layer 8, which is arranged between the refractive surface 7 and the light influencing means 9. The connecting layer can, for example, consist of liquid silicone rubber (LSR).

The light influencing means 9 serve as an imaging element and can be designed, for example, as a digital micromirror device (DMD) or as an LCoS (Liquid Crystal on Silicon) or as an LC display. An active surface of the light influencing means 9 is designed in such a way that it reflects parts of the light 4 emitted from the refractive surface 7 back to the refractive surface 7.

Through the refractive surface 7, the parts of the light 4 reflected by the active surface of the light influencing means 9 are coupled back into optical component 2. A refractive exit surface 10 of the optical component 2 is arranged on the side of the optical component 2 opposite to the surface 7, which serves as decoupling optics. The exit surface 10, for example, can be aspherically shaped and/or designed as a free-form surface. The exit surface 10 images the active surface of the light influencing means 9 into a projection plane 11 in the traffic space.

LIST OF REFERENCE SYMBOLS

1 light source
2 optical component
3 entry surface
4 light emitted by the light source
5 reflector
6 mirror element
7 refractive surface
8 connecting layer
9 light influencing means
10 exit surface
11 projection plane

The invention claimed is:

1. A Lighting device for a motor vehicle comprising:

at least one light source from which light is emitted during operation of the lighting device, an optical component into which the light emanating from the at least one light source enters, a light influencing mechanism arranged outside the optical component and having an active surface for selectively influencing individual pixels or groups of pixels of the light, the light influencing mechanism reflecting or deflecting light incident thereon in such a way that the light incident thereon is reflected or deflected back into the optical component and then emerges at least partially from the lighting device, a connecting layer arranged between an outside of the optical component and the light influencing mechanism that couples the light influencing mechanism to the outside of the optical component, and illumination optics formed on or in the optical component, wherein the illumination optics reflect or deflect the light emanating from the at least one light source out of the optical component and onto the active surface of the light influencing mechanism.

2. The lighting device according to claim 1, wherein the light influencing mechanism is in direct or indirect contact with a section of the outside of the optical component through which light can exit from and enter the optical component.

3. The lighting device according to claim, wherein the connecting layer is liquid silicon rubber.

4. The lighting device according to claim 1, wherein the light influencing mechanism is a digital micromirror device or an LCoS or as LC display, or that the light influencing mechanism comprises a digital micro-mirror device or an LCoS or an LC display.

5. The lighting device according to claim 1, wherein the illumination optics comprise a reflector having a single uninterrupted mirror surface or a plurality of mirror elements.

6. The lighting device according to claim 5, wherein the reflector has a concave curved base surface.

7. The lighting device according to claim 5, wherein the reflector is formed by a reflecting surface of the optical component.

8. The lighting device according to claim 1, wherein the lighting device comprises decoupling optics through which the light emitted by the light influencing mechanism emerges from the lighting device during operation of the lighting device.

9. The lighting device according to claim 8, wherein the decoupling optics are integrated into the optical component as an exit surface thereof.

10. The lighting device according to claim 9, wherein the exit surface being aspherically curved and/or being designed as a free-form surface.

11. The lighting device according to claim 1, wherein the optical component is a monolithic component.

12. The lighting device according to claim 1, wherein the optical component consists of glass or polycarbonates (PC).

13. The lighting device according to claim 1, wherein the at least one light source is a laser light source or a light-emitting diode.

* * * * *